US008466634B2

(12) United States Patent
Godbole

(10) Patent No.: US 8,466,634 B2
(45) Date of Patent: Jun. 18, 2013

(54) PHASE CONTROL FOR HYSTERETIC CONTROLLER

(75) Inventor: Kedar Godbole, San Jose, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 1163 days.

(21) Appl. No.: 12/337,876

(22) Filed: Dec. 18, 2008

(65) Prior Publication Data

US 2009/0160368 A1 Jun. 25, 2009

Related U.S. Application Data

(60) Provisional application No. 61/015,725, filed on Dec. 21, 2007, provisional application No. 61/015,768, filed on Dec. 21, 2007.

(51) Int. Cl.
*H05B 37/02* (2006.01)
*G05F 1/00* (2006.01)

(52) U.S. Cl.
USPC ..... 315/307; 323/282

(58) Field of Classification Search
USPC ..... 315/209 R, 224, 225, 246, 291, 307; 323/275, 282–285
See application file for complete search history.

(56) References Cited

U.S. PATENT DOCUMENTS

| | | | | |
|---|---|---|---|---|
| 5,675,481 | A | 10/1997 | Erisman | |
| 6,348,780 | B1 * | 2/2002 | Grant | 323/222 |
| 6,489,809 | B2 | 12/2002 | Kiehl | |
| 6,495,995 | B2 * | 12/2002 | Groom et al. | 323/283 |
| 6,696,861 | B1 | 2/2004 | Baldwin et al. | |
| 6,922,044 | B2 * | 7/2005 | Walters et al. | 323/288 |
| 8,120,334 | B2 * | 2/2012 | Valley et al. | 323/222 |
| 2002/0063937 | A1 * | 5/2002 | Kikuchi | 359/189 |

OTHER PUBLICATIONS

International Search Report of the International Searching Authority, dated Mar. 23, 2009 for International Application No. PCT/US2008/087359; 3 pages.

International Written Opinion of the International Searching Authority, dated Mar. 23, 2009 for International Application No. PCT/US2008/087359: 3 pages.

* cited by examiner

*Primary Examiner* — Jimmy Vu

(57) ABSTRACT

A driver circuit, and light emitting system and method are provided. The driver circuit includes possibly a controller and a phase detector coupled to produce an intermittent output proportional to a value of an input relative to upper and lower threshold values, and a difference between the input signal, which is the intermittent output signal, and a reference value. The light emitting system can include a switch and at least one light emitting device coupled to the switch. The driver circuit can be coupled to forward the intermittent output signal to the switch that is active in proportion to current level through the light emitting device, rising and falling between the modifiable upper and lower threshold values.

12 Claims, 8 Drawing Sheets

PHASE CONTROL FOR HYSTERETIC CONTROLLER

PRIORITY CLAIM

This application claims priority to U.S. Provisional Application No. 61/015,725 filed Dec. 21, 2007 which is incorporated herein by reference. This application also claims priority to and benefit of U.S. provisional patent application number 61/015,768, filed Dec. 21, 2007.

TECHNICAL FIELD

This disclosure relates to electronic circuits and, more particularly, to a circuit and system for driving light emitting devices such as light emitting diodes (LEDs).

BACKGROUND

The concept of hysteresis is somewhat known, in that a system does not immediately respond to a stimulus, but has some delay associated with that response. This effect is oftentimes desired in many applications. For example, the thermostat of a heater or air conditioner must have a certain amount of hysteresis, otherwise the heater or air conditioner would cycle on and off at a rapid rate once the temperature reached the thermostat setting. With hysteresis, the thermostat or controller which controls operation of the air conditioning system will not turn on the moment the ambient temperature reaches the thermostat setting or slightly exceeds that setting, but instead is delayed. In a general sense, such controllers are oftentimes referred to as "hysteretic controllers." Hysteretic controllers can be used in numerous applications, well beyond the example of an air conditioner or heater. Most hysteretic controllers follow the concept of the hysteresis loop, and take advantage of the affects of hysteresis by turning off and on a delayed time after reaching upper and lower threshold limits, respectively. Thus, most hysteretic controllers implement some form of upper and lower threshold limits to engage and disengage the control function.

While hysteretic controllers are prevalent in many systems, the timing in which they are engaged or active, or when disengaged or inactive, oftentimes depends on the components of the system, beyond just the environment in which they operate. For example, the components of the hysteretic controller can change over temperature or time, or simply change due to design flaws which are inherent in their operation. If so, the phase relationship of when the controller becomes active or inactive can rapidly change, creating circuit operation problems. This deleterious effect becomes profound when a controller is desired to activate a load or deactivate a load at a specific time, yet does so at unacceptable times well beyond the normal hysteretic lag.

DETAILED DESCRIPTION

In an embodiment, a driver circuit is provided. The driver circuit includes a controller such as a hysteretic controller, coupled to receive an input and produce an intermittent output proportional to a value of the input relative to upper and lower threshold values. The driver circuit can also include a phase detector coupled to receive the intermittent output and a reference value, and to produce a series of control pulses whose density is proportional to a phase difference between the input signal and the reference value. A threshold controller can be coupled to receive the control pulses and modify, in proportion to the density of the control pulses, the upper and lower threshold values.

In an embodiment, a light emitting system is provided. The system includes a switch, and a least one light emitting device coupled to the switch. A driver circuit can be coupled to forward an intermittent output signal to that switch that is active in proportion to current levels through the light emitting device, rising and falling between modifiable upper and lower threshold values.

In an embodiment, a method is provided for emitting light. The method includes reading current through a light emitting device, and controlling an amount of light through a light emitting device depending on the magnitude of read current between upper and lower threshold values. The method can also include controlling a timing of light through the light emitting device depending on a phase difference between the read current and a reference signal.

Figure 1:
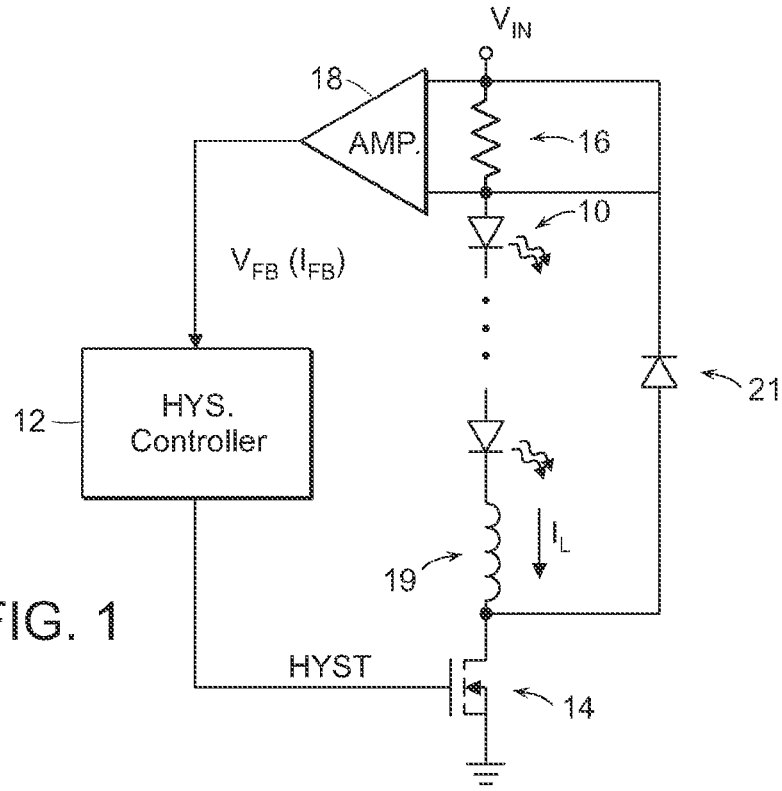
FIG. 1 is a circuit schematic and block diagram of a driver circuit having a hysteretic controller for controlling a light emitting device according to one embodiment.

Turning now to the drawings, FIG. 1 illustrates at least one light emitting device 10 driven by a hysteretic controller 12. Device 10 can include one or more devices coupled in series with a switch 14. Device 10 can be connected in series or a plurality of devices can be connected in parallel. Whether connected in series, parallel, or a plurality of series-connected devices coupled in parallel, or a plurality of parallel-connected devices in series, one or more devices can be coupled in series with switch 14. Those devices can represent an array of devices, yet all such devices are operated through switch 14. Devices 10 include any illumination device which responds to current and/or voltage. Switch 14 is part of a circuit which drives the light emitting devices, and is used to enable or disable current ($I_L$) through at least one device 10. When placed in an "on" or "enabled" state, switch 14 implements a path with a relatively small voltage drop or small resistance between device 10 and a supply voltage or ground, as in the example shown. When in the "off" or "disabled" state, switch 14 undergoes a relatively high resistance between device 10 and the power supply or ground, as shown. The difference in resistance between a low resistance on state and a high resistance off state can be generally in the ratio of 1:100 or more.

The current $I_L$ through device 10 is regulated. Regulation is determined by measuring or sensing the voltage across resistor 16. That voltage is proportional to $I_L$ as amplified by an amplifier 18, whose output is the feedback value ($I_{FB}$ or $V_{FB}$). The feedback value is applied to controller 12, which compares that value to an upper and lower threshold value, similar to a hysteretic control mechanism. Depending upon the comparison outcome, controller 12 will activate or deactivate switch 14.

Figure 2:
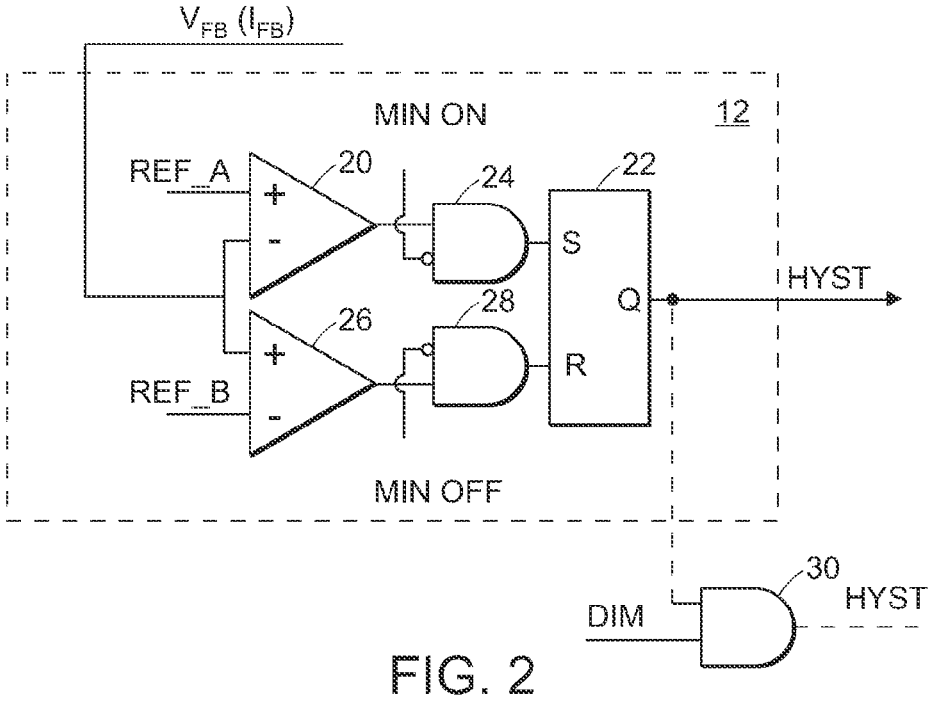
FIG. 2 is a circuit schematic of the hysteretic controller of FIG. 1 with optional dimming functionality at the output according to one embodiment.

Controller 12 can be considered a hysteretic controller. As the sequence begins with current $I_L$ at the 0 level, current is measured by the voltage across the sense resistor 16. As shown in FIG. 2, the feedback value $V_{FB}$ registers a quantity less than the lower threshold value (REF_A) causing comparator 20 to activate a set within flip-flop 22 via gate 24. That set value registers as a logic high value on signal HYST or controller 12 output. Once HYST goes high, switch 14 is active, and current $I_L$ increases until sense resistor 16 senses a feedback value that exceeds the upper threshold value of REF_B. When this happens, comparator 26 produces a reset on flip-flop 22 via gate 28. That reset causes HYST to transition to a logic low voltage value, turning off switch 14 and causing current $I_L$ to once again decrease.

When switch 14 goes inactive, inductor 19 (FIG. 1) voltage polarity reverses in an attempt to maintain the inductor current. This drives the voltage at the drain node of switch 14 to a relatively high voltage value, causing diode 21 to become forward-biased and turn on. This transfers the current through the diode, allowing switch 14 current to substantially reduce to 0.

As shown in FIG. 2, a DIM signal can be placed at a logic high voltage value, and as an option, a logic gate 30 can be implemented to output the HYST signal, rather than outputting HYST directly from the Q output of flip-flop 22. Only when the DIM signal is at a logic high voltage value will the current $I_L$ through device 10 extend upward, downward, and upward again between the upper and lower threshold value set by REF_A and REF_B. When the DIM signal goes low, the output from logic gate 30 goes low, irrespective of the current in the LED circuit and the gate of switch 14 must then go to a logic low voltage value, and remains low even as the inductor current drops to a substantially low value.

Switch 14 can be any switch that can trigger a high or low conductive state between terminals in response to a controlling terminal voltage. In an example, switch 14 can be a field-effect transistor, such as an N-channel metal oxide semiconductor (NMOS) transistor. If switch 14 is an NMOS device, then a logic low or "0" voltage value upon the gate of switch 14 would cause a high resistance or low conductance state, thereby decreasing $I_L$ below the lower threshold. Logic gate 30 should be of adequate drive strength to drive switch 14 in accordance with desired operating characteristics. It is also to be noted that the examples herein are written for positive logic; however, similar implementations are possible with a negative logic system.

Figure 3:
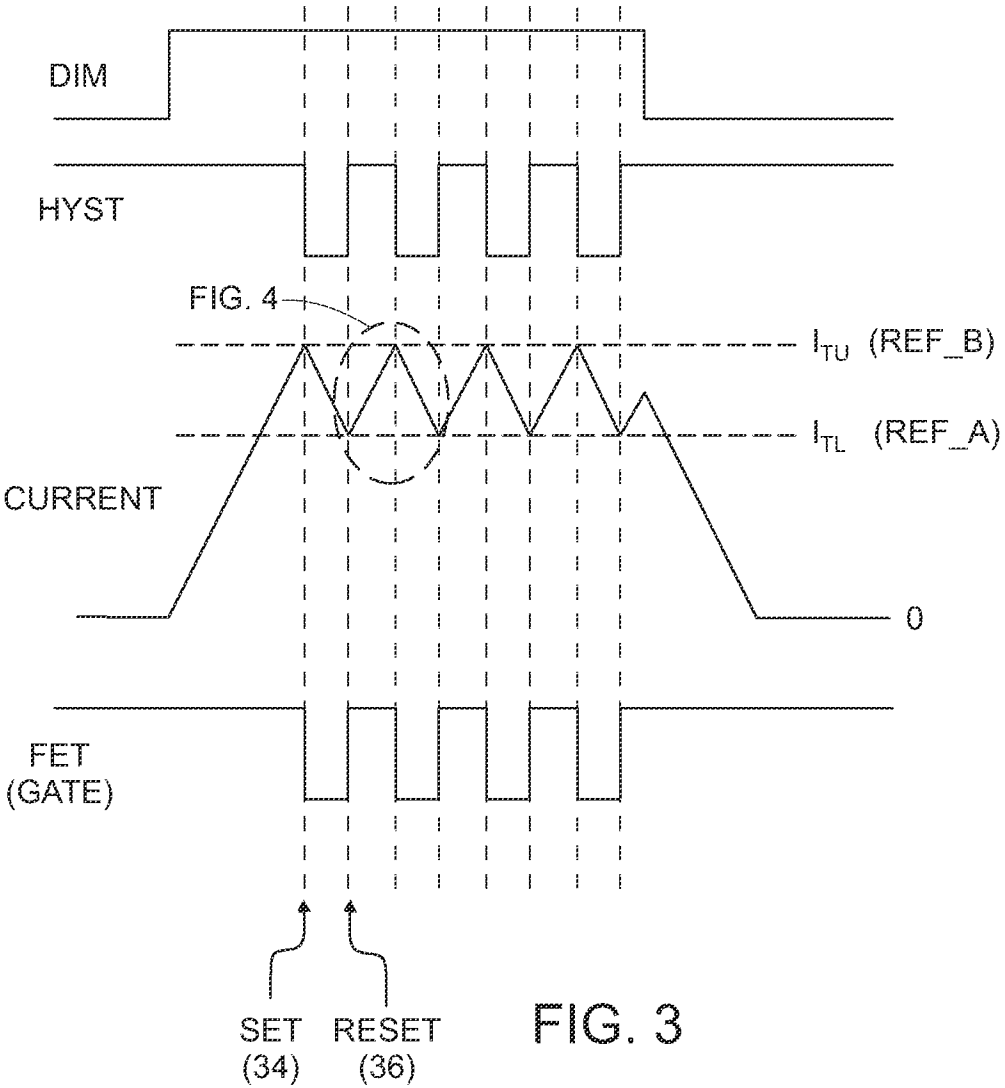
FIG. 3 is a timing diagram of various waveforms used by the driver circuit according to one embodiment.

Referring to FIG. 3, it is not until both DIM and HYST input signals to the logic gate go high at time 34 will current $I_L$ ramp upward from a substantially 0 current level. Thereafter, the current will extend between the upper and lower current levels of the set threshold. As current modulates between the upper and lower thresholds of $I_{TU}$ and $I_{TL}$, respectively, the hysteretic or other TDF (temporal density function) signal, such as HYST, will also modulate. Accordingly, the HYST signal can signify hysteretic control or pulse width modulation, or other density modulation functions. To implement dimming of the light emitting device 10, a temporal density function is used to gate the operation of switch 14. The light output of device 10 is substantially stopped by this temporal density function. Controlling the ratio of the time in which the density function is high or on and the time it is low or off, the average output of the light emitting device is controlled. Since the human eye has a rather long time constant, the human eye averages this light output to interpret a control of the illumination intensity.

Proper operation requires the device to substantially turn off during the low period of the density function. Therefore, as shown by the HYST signal, when that signal goes low, the current $I_L$ will decrease from $I_{TU}$ to $I_{TL}$ (FIG. 3). When the temporal density function goes high or HYST goes high, current $I_L$ will transition from the lower threshold $I_{TL}$ to the upper threshold $I_{TU}$. At time 34, flip-flop 22 (FIG. 2) will be set. When the HYST signal temporal density function goes low at time 36, for example, flip-flop 22 is reset. The periodic or intermittent set and reset consistent with the temporal density function of logic high and low voltage values on the HYST signal causes an intermittent output signal from hysteretic controller 12 (FIG. 1). This causes intermittent turning on and off of switch 14 (FIG. 1).

Figure 4:
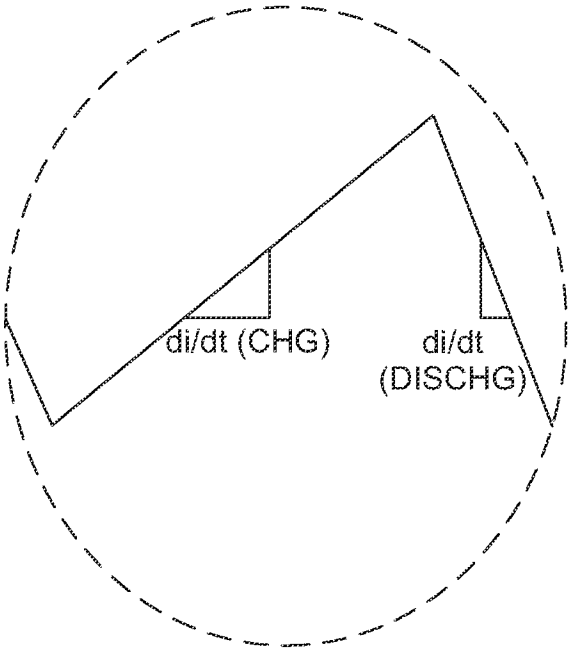
FIG. 4 is a detailed timing diagram of the hysteretic controlled current through the light emitting devices and, particularly, of charging and discharging current through the light emitting devices according to one embodiment.

As switch 14 is placed into saturation or a low resistive state, the current through device 10 (FIG. 1) will increase due to inductor 19 being charged. Conversely, when switch 14 is off, current through device 10 discharges, as shown in the detail of FIG. 4. More specifically, FIG. 4 illustrates a greater slew rate for charging the inductor current than discharging. This is due to many factors. For example, when switch 14 is on, the voltage that appears across the inductor L equals $V_{IN}-V_{LED}-V_{RSENSE}-V_{FET}$. However, when switch 14 is off, the voltage across inductor L equals $V_{IN}-V_{LED}-V_{RSENSE}$. Therefore, the change in current or di/dt during the switch "on" state is $(V_{IN}-V_{LED}-V_{RSENSE}-V_{FET})/L$. However, the current change when switch 14 is "off" is substantially more or $(V_{IN}-V_{LED}-V_{RSENSE})/L$. The detailed drawing of slew rate shown in FIG. 4 shows a disparity between when current is being increased through device 10 versus when it is being decreased. Of course, there are other factors which cause the rate of change in current increase to be less than its decrease. That rate of change can depend on the input voltage $V_{IN}$ and the inductor value L, etc. Other factors can be the tolerance in the sense resistor 16, and the variations in the parameters of the switch 14, or other circuit variations such as, for example, temperature effect and process variations.

As the current changes during the device current increase and decrease can vary with circuit parameters and, the frequency of operation of any given hysteretic controller becomes unknown within a fairly broad range. This means that there are several problems for such a circuit. Absent any fixed phase relationship, when multiple controllers are used, the input currents of each multiple controller interact to cause a deep frequency to exist and create circuit problems, such as spikes in input current.

Figure 5:
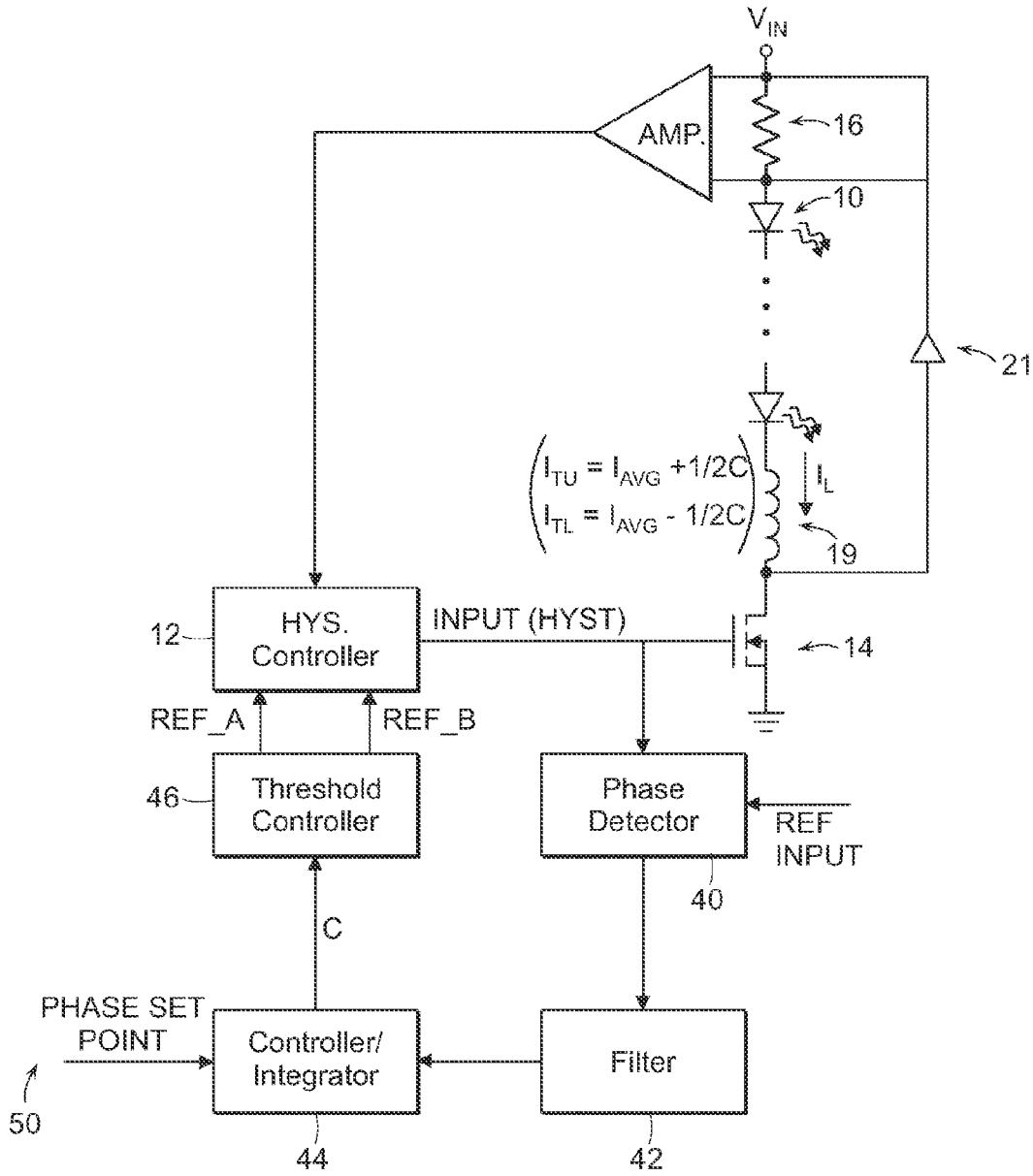
FIG. 5 is a circuit schematic and block diagram of a driver circuit with phase control of the hysteretic controller according to one embodiment.

FIG. 5 illustrates a mechanism for controlling the phrase and frequency relationship of the HYST output given the rather substantial fluctuations in the current increase and decrease slew rate through device 10. Instead of simply taking the HYST output and using that output to control $I_L$, the HYST output is phase and frequency locked to a controllable reference input (REF INPUT). The reference input or reference value is compared with the HYST output which becomes an input along with REF INPUT to phase detector 40. Phase detector 40 compares the phase of the HYST input and the reference input, and depending on that comparison, produces control pulses whose temporal density relates to the phase difference. The control pulses can be filtered using, for example, a low pass filter 42, and then applied to a control function or closed loop compensator 44. A user can input a phase set point to modify the phase of the control pulses if desired. The control pulses (C) are then fed to a threshold controller 46 which generates an increase or decrease in the upper and lower threshold voltages, REF_B and REF_A, respectively. By changing the upper and lower threshold values, the upper and lower threshold currents, $I_{TU}$ and $I_{TL}$, respectively, can be changed by adding or subtracting ½ the control value (C) to the averaged current value. Thus, $I_{TU}=I_{AVG}+\frac{1}{2}C$ and $I_{TL}=I_{AVG}-\frac{1}{2}C$.

Figure 6:
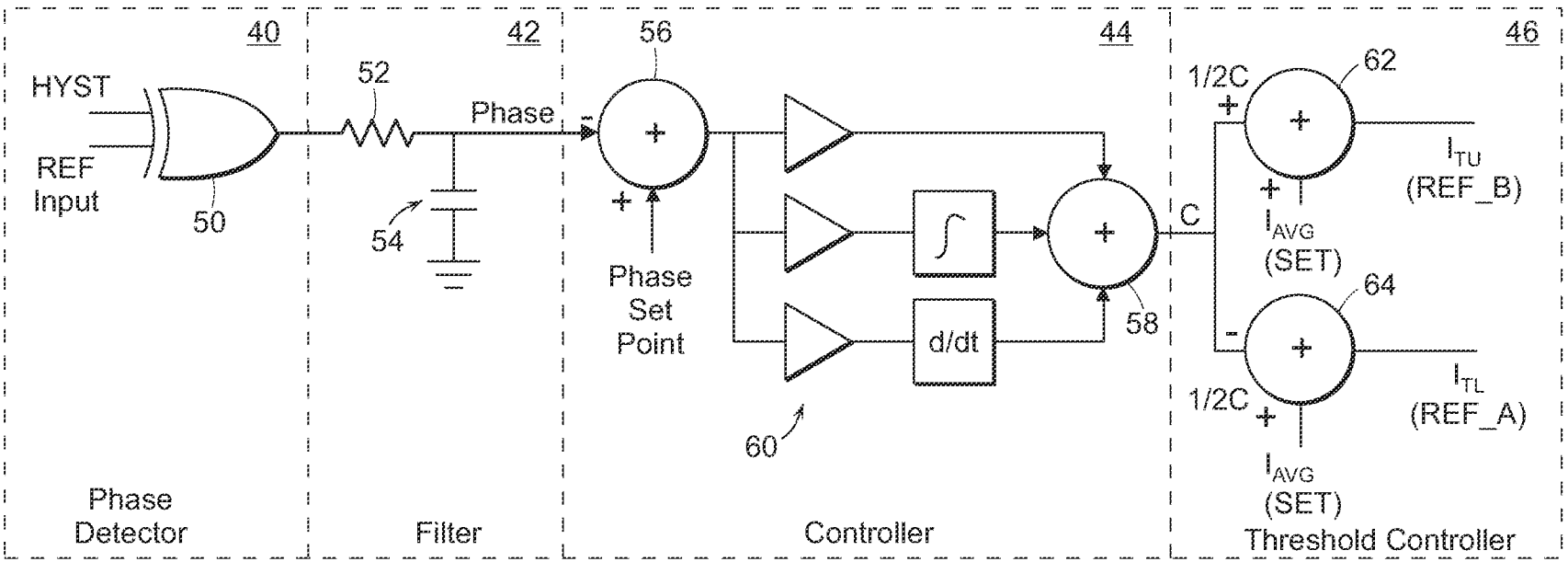
FIG. 6 is a circuit schematic of the phase control features of FIG. 5, according to one embodiment.

FIG. 6 illustrates an example of circuitry which may be used to carry out the block functions of FIG. 5. For example, phase detector 40 can be implemented as an exclusive OR gate 50, and filter 42 can be a low pass filter with a resistive element 52 and capacitive element 54. The control function or closed loop compensator 44 can be formed with a pair of adders 56, 58 along with amplifiers, integrators, and differentiators, shown collectively as reference 60. Threshold controller 46 can be implemented as a pair of adders 62, 64 which add and subtract ½C from an average set value $I_{AVG}$ to produce the upper and lower threshold values of REF_B or $I_{TU}$ and REF_A or $I_{TL}$, respectively. While FIG. 6 illustrates one implementation for the blocks of FIG. 5, there are multiple alternatives which can also be used. For sake of brevity, all alternatives are not shown, but would be readily known to a skilled artisan to modify the circuitry yet achieve the same functionality within the scope and spirit of this disclosure.

Figure 7:
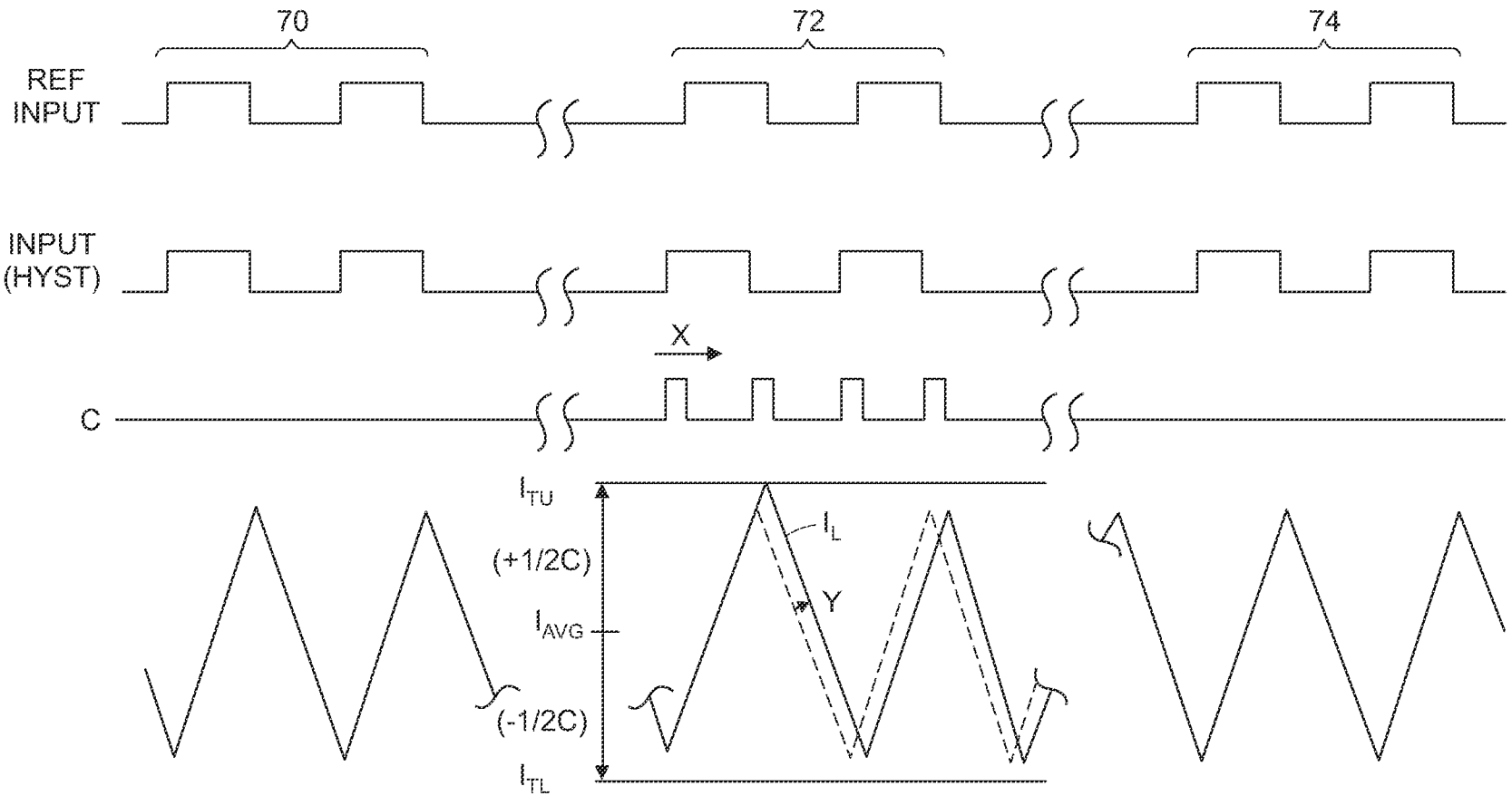
FIG. 7 is a timing diagram of the phase adjustment according to a phase comparison between an input signal and a reference signal according to one embodiment.

FIG. 7 illustrates various waveforms used to change the phase of a HYST input signal depending on a reference input. During time 70, HYST is synchronized to the REF INPUT, and minimal, if any, control pulses are produced at the output of a phase detector. However, during time 72, HYST input leads the REF INPUT, causing control signal C to be produced proportional to an amount by which HYST leads REF INPUT. During those instances of non-sync, the control signal will cause an increase the separation between the upper and lower threshold values ($I_{TU}$ and $I_{TL}$, respectively) to allow $I_L$ to extend upward to $I_{TU}$, in order to slow down the HYST signal. After one or more cycles, the HYST signal will again slow down to the REF INPUT signal, and again be synchronized as shown by time 74. Once synchronized, control pulses no longer exist, and the upper and lower thresholds resume, contracting backward toward $I_{AVG}$.

An increase in the threshold separation will cause the HYST input to slow down, and once again be locked in phase and frequency with the reference input. The opposite will occur if the separation between the thresholds decreases. By making the thresholds variable rather than fixed, one can compensate for the differences in slew rate caused by charging and discharging the inductor placed in series with the light emitting devices. Thus, any lag caused by charging through the devices can be decreased by decreasing the separation of the thresholds. Conversely, any undue leading caused by a lower slew rate can be compensated by increasing the threshold separation, causing the HYST signal to decrease or lag. Since the lag or lead manifests itself as a decrease or increase in frequency, it will tend to accumulate over time, resulting in a phase error, and most likely a "roll over" phase error. In a roll over the phase error accumulates from 0° to 360°, and since a phase delay of 360° is identical to 0° for many purposes, it is rolled over, similar to a car odometer rolling over. Using a feedback arrangement and detecting a phase difference with a reference input, causes the hysteretic controller to slow down or speed up in frequency and phase, making the controller more controllable than typical hysteretic controllers. However, the average current $I_{AVG}$ remains unchanged since both thresholds are moved, either through an increase in separation or a decrease. This causes the phase control to be independent of the current control, or other variable control function.

The driver circuit which comprises controller 12, phase detector 40, filter 42, controller 44, and threshold controller 46 is hereinafter referred to as "driver circuit 50." Driver circuit 50 can be synthesized for other controlled variables and other controlled topologies, as well as other loads controlled by a hysteretic controller. The driver 50 functionality can be implemented in either hardware or software, and the simulation results of such are shown in FIG. 10, for example.

Figure 10:
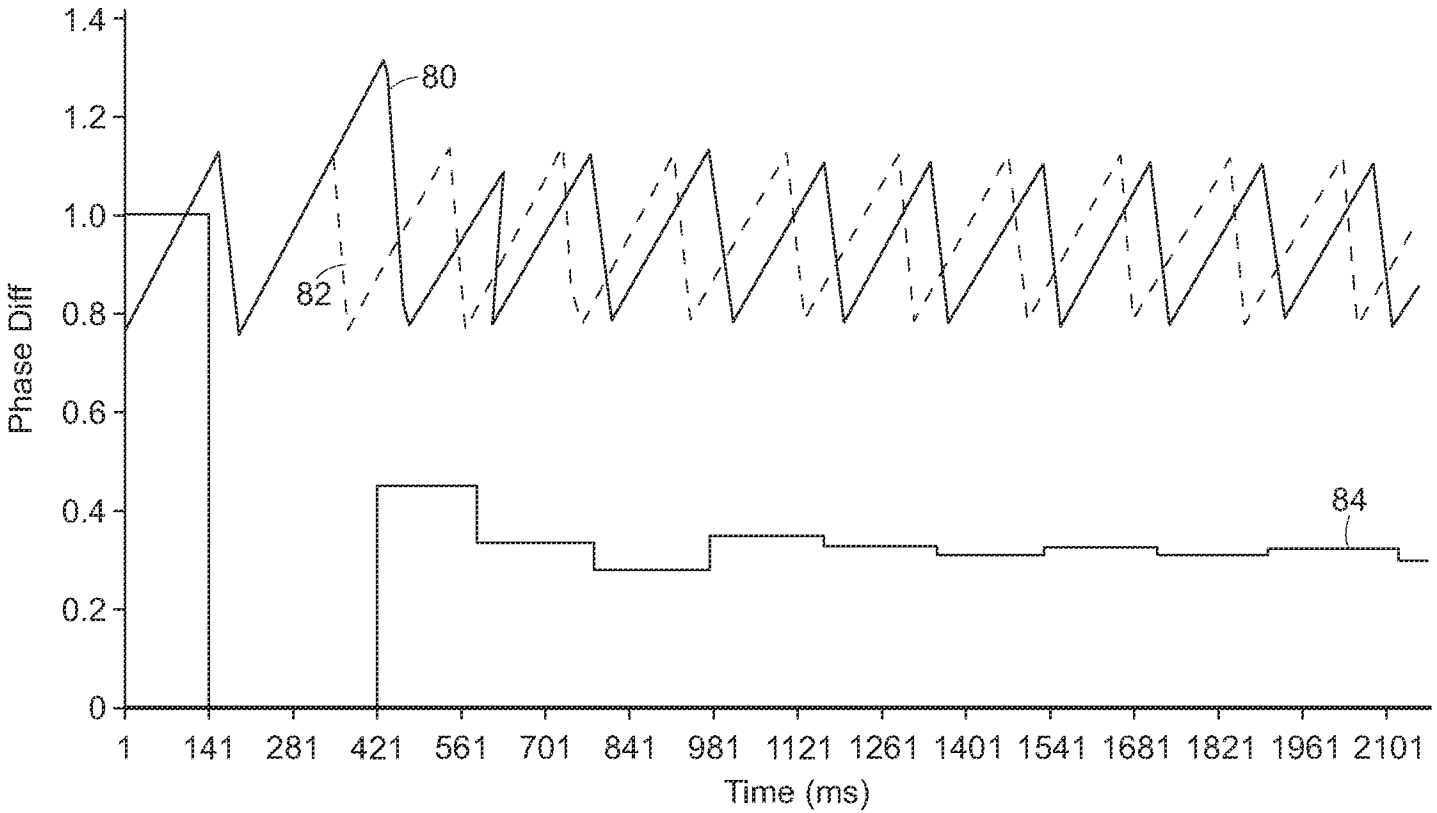
FIG. 10 is a simulation result of the hysteretic controller and driver circuit of FIG. 5 showing phase offset before and after correction, with a fixed phase set point plotted as voltage/time according to one embodiment.

As shown in FIG. 10, the upper threshold can be increased to allow the HYST signal 80 to lag the REF INPUT signal 82. Over time, the HYST signal will be synchronized in phase and frequency with the REF INPUT, unless a phase set point is established to maintain a phase difference between the HYST and REF INPUT signals. In the simulation of FIG. 10 a phase set point is established at approximately ⅓ cycle or 120° difference between the lagging HYST signal and the REF INPUT signal 82. The approximate 0.3 cycle difference is shown as being maintained substantially at steady state by the phase difference plot 84.

Figure 8:
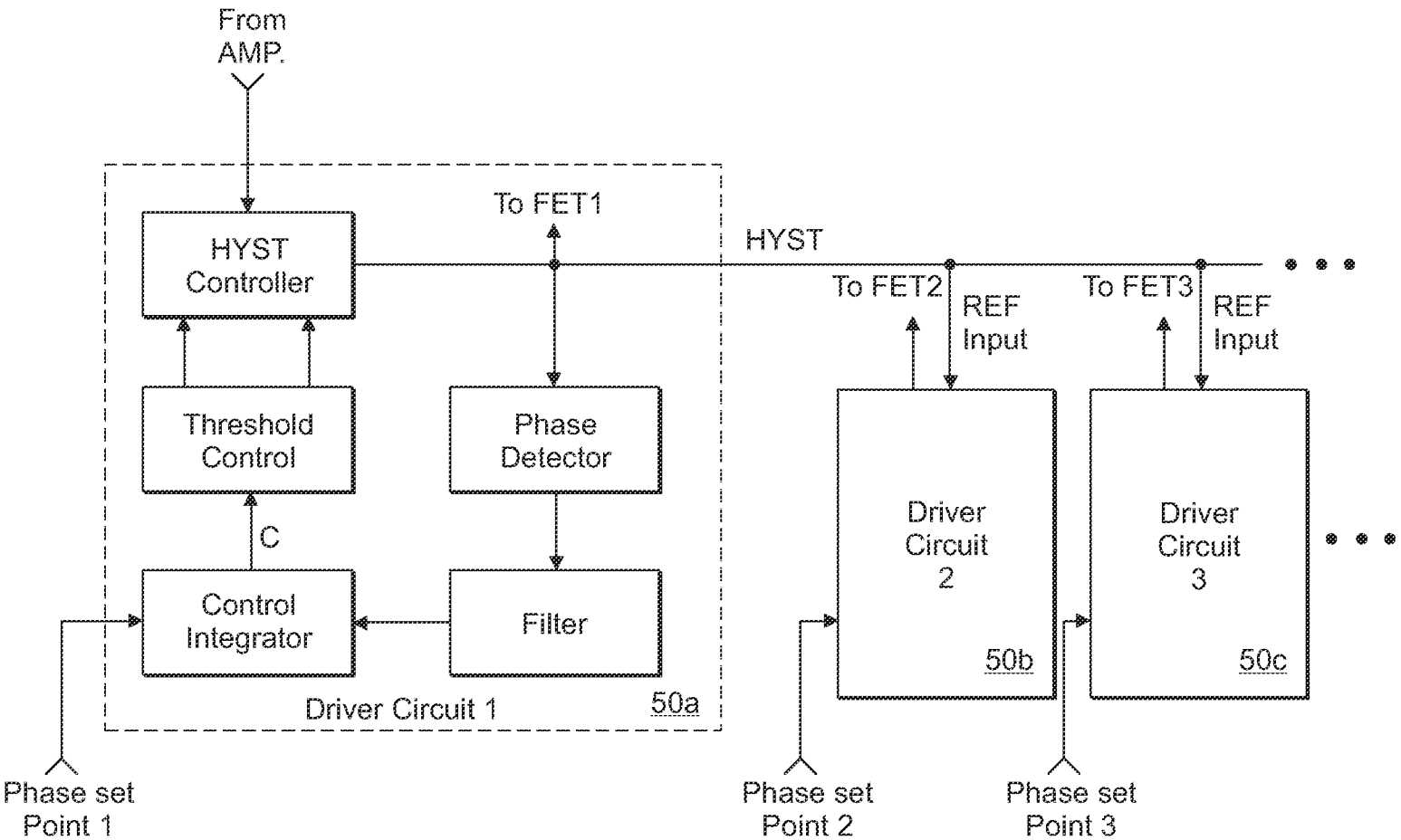
FIG. 8 is a block diagram of multiple controllers synchronized to an output of a controller according to one embodiment.
Figure 9:
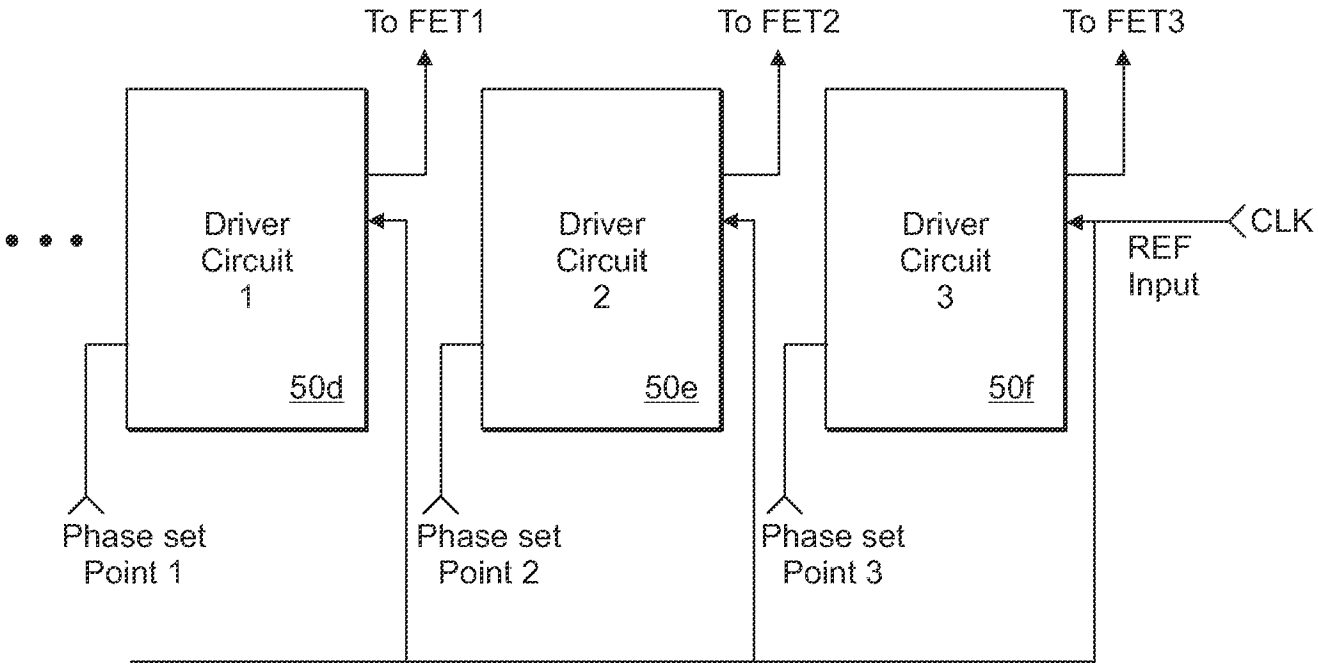
FIG. 9 is a block diagram of multiple controllers synchronized to a master clocking source according to one embodiment.

Turning now to FIGS. 8 and 9, it is understood that the HYST signal from one driver circuit can be used as a synchronizing signal for other driver circuits as shown in FIG. 8, or the REF INPUT signal can be used to synchronize multiple driver circuits as shown in FIG. 9. FIG. 8 illustrates a driver circuit 50a that produces a HYST output to a first switch or FET1 for driving a light emitting device associated with driver circuit 50a. The HYST signal can also be forwarded to a REF INPUT of a second driver circuit 50*b*. The HYST signal from the first driver circuit 50*a* is used to synchronize the HYST output from the second driver circuit 50*b*. The HYST output from the first driver circuit 50*a* can also be used to synchronize a third driver circuit 50*c* and, specifically, the third HYST signal sent to its associated switch or FET3.

In one alternative embodiment of FIG. 9, a single REF INPUT is established through a synchronizing circuit or clocking circuit, can be used to synchronize multiple driver circuits and is applied to the REF INPUT pin or node of those corresponding driver circuits 50*d*, 50*e*, and 50*f*. That single REF INPUT source synchronizes driver circuits 50*d*, 50*e*, and 50*f* and, more specifically, the FET1, FET2, and FET3 inputs. FIGS. 8 and 9 indicate that two or more hysteretic controllers can be synchronized, avoiding input current spikes from switching currents. The hysteretic controllers can be phase locked to the reference, providing predictable switching to facilitate measurements in the circuit. By changing one or more of the phase set points, the driver circuit outputs can be phase staggered. For example, driver circuit 1 set point can be at 30°, while driver circuit 2 set point can be at 60°, and driver circuit 3 set point can be at 90°, yet each of the driver circuits 50*d*, 50*e*, and 50*f* utilize the same REF INPUT source. By staggering the FET1, FET2, and FET3 outputs 30°, in this example, the light emitting devices can be staggered as to when they turn on.

It should be appreciated that in the foregoing descriptions of embodiments, various features are sometimes grouped together in an embodiment, figure, or description thereof for the purpose of streamlining the disclosure, and aiding in the understanding of one or more of the various aspects. For example, any controller which can achieve variable thresholds utilizing possibly a phase detector and filter functions, and an in-system reference waveform generator function, as well as other constant voltage and constant current sources fall within the described embodiments. Moreover, synchronizing or phase offsetting one or more hysteretic controllers to a reference signal, or synchronizing one hysteretic controller to another, also fall within the described embodiments. A fixed frequency relationship can occur between more than one controller, preventing undesirable interaction of their source currents. This fixed relationship is achieved using a common reference input and differing phase set points. This allows control of EMI signatures with simple to design and simple to use hysteretic controllers, and provides a key in driving future high ampere light emitting devices suitable for the lighting industry. As the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

What is claimed is:

1. A driver circuit, comprising:

a first controller coupled to receive a first input and produce a first intermittent output proportional to a value of the first input relative to first upper and lower threshold values;

a first phase detector coupled to receive the first intermittent output and a reference value, and to produce a first series of control pulses whose density is proportional to a phase difference between the first input and the reference value;

a first threshold controller coupled to receive the first series of control pulses and configured to modify the first upper and lower threshold values in accordance with the density of the first series of control pulses;

a second controller coupled to receive a second input and produce a second intermittent output proportional to a value of the second input relative to second upper and lower threshold values;

a second phase detector coupled to receive the second intermittent output and the first intermittent output, and to produce a second series of control pulses whose density is proportional to a phase difference between the second intermittent output and the first intermittent output; and a second threshold controller coupled to receive the second series of control pulses and for modifying, in proportion to the density of the second series of control pulses, the second upper and lower threshold values.

2. The driver circuit as recited in claim 1, wherein at least one of the first controller and the second controller comprises a hysteretic controller.

3. The driver circuit as recited in claim 1, further comprising a first adder configured to add the density of the first series of control pulses to an upper set point;

and wherein the first threshold controller further comprises a second adder configured to add the density of the first series of control pulses to a lower set point.

4. The driver circuit as recited in claim 1, wherein the density of the first intermittent output that is active is further proportional to a phase difference between the first input and the reference value.

5. A driver circuit, comprising:

a first controller coupled to receive a first input and produce a first intermittent output proportional to a value of the first input relative to first upper and lower threshold values;

a first phase detector coupled to receive the first intermittent output and a reference value, and to produce a first series of control pulses whose density is proportional to a phase difference between the first input and the reference value;

a first threshold controller coupled to receive the first series of control pulses and configured to modify the first upper and lower threshold values in accordance with the density of the first series of control pulses;

a second controller coupled to receive a second input and produce a second intermittent output proportional to a value of the second input relative to second upper and lower threshold values;

a second phase detector coupled to receive the second intermittent output and the reference value, and to produce a second series of control pulses whose density is proportional to a phase difference between the second intermittent output and the reference value; and a second threshold controller coupled to receive the second series of control pulses and for modifying, in proportion to the density of the second series of control pulses, the second upper and lower threshold values.

6. The driver circuit as recited in claim 5, wherein at least one of the first controller and the second controller comprises a hysteretic controller.

7. The driver circuit as recited in claim 5, further comprising a first adder configured to add the density of the first series of control pulses to an upper set point;

and wherein the first threshold controller further comprises a second adder configured to add the density of the first series of control pulses to a lower set point.

8. The driver circuit as recited in claim 5, wherein the density of the first intermittent output that is active is further proportional to a phase difference between the first input and the reference value.

9. A driver circuit, comprising:

a controller coupled to receive an input and produce an intermittent output proportional to a value of the input relative to upper and lower threshold values;

a phase detector coupled to receive the intermittent output and a reference value, and to produce a series of control pulses whose density is proportional to a phase difference between the input and the reference value;

a threshold controller coupled to receive the control pulses and configured to modify the upper and lower threshold values in accordance with the density of the control pulses; and a first adder for adding a user selected set point value to the series of control pulses to offset the phase of the intermittent output from the phase of the reference value.

10. The driver circuit as recited in claim 9, wherein the controller comprises a hysteretic controller.

11. The driver circuit as recited in claim 9, further comprising a second adder configured to add the density of the control pulses to an upper set point; and wherein the threshold controller further comprises a third adder configured to add the density of the control pulses to a lower set point.

12. The driver circuit as recited in claim 9, wherein the density of the intermittent output that is active is further proportional to a phase difference between the input and the reference value.

* * * * *